US005562739A

United States Patent [19]

Urben

[11] Patent Number: 5,562,739

[45] Date of Patent: Oct. 8, 1996

[54] LYOCELL FIBER TREATMENT METHOD

[75] Inventor: Peter G. Urben, Kenilworth, United Kingdom

[73] Assignee: Courtaulds Fibres (Holdings) Limited, London, United Kingdom

[21] Appl. No.: 444,709

[22] Filed: May 19, 1995

[30] Foreign Application Priority Data

Jun. 1, 1994 [GB] United Kingdom ..... 9410912

[51] Int. Cl.[6] ..... D06M 13/123

[52] U.S. Cl. ..... 8/116.4; 8/120; 8/116.1

[58] Field of Search ..... 8/116.4, 116.1, 8/120, 127.6, 115.56, 115.57

[56] References Cited

U.S. PATENT DOCUMENTS

| | | | |
|---|---|---|---|
| 2,394,306 | 2/1946 | Hentrich et al. . | |
| 2,826,514 | 3/1958 | Schroeder | 8/116.4 |
| 2,892,674 | 6/1959 | Sause et al. . | |
| 2,971,815 | 2/1961 | Bullock et al. : | |
| 3,294,778 | 12/1966 | Randall et al. . | |
| 3,383,443 | 5/1968 | Leahy et al. . | |
| 3,400,127 | 9/1968 | Tesoro et al. . | |
| 3,461,052 | 8/1969 | Restaino et al. . | |

(List continued on next page.)

FOREIGN PATENT DOCUMENTS

| | | |
|---|---|---|
| 40668/78 | 4/1980 | Australia . |
| 044172 | 1/1982 | European Pat. Off. . |
| 118983 | 9/1984 | European Pat. Off. . |
| 174794 | 3/1986 | European Pat. Off. . |
| 252649 | 1/1988 | European Pat. Off. . |
| 437816 | 7/1991 | European Pat. Off. . |
| 466648 | 1/1992 | European Pat. Off. . |
| 538977 | 4/1993 | European Pat. Off. . |
| 1148892 | 12/1957 | France . |

(List continued on next page.)

OTHER PUBLICATIONS

"Radiopaque Polymers to Safety", Encyclopedia of Polymer Science and Engineering, vol. 14, pp. 45–46, 57–59, John Wiley & Sons, Inc. (1988) (Month Unknown).

"Styrene Polymers to Toys", Encyclopedia of Polymer Science and Engineering, vol. 16, pp. 16 and 685, John Wiley & Sons, Inc. (1989) (Month Unkown).

R. Moncrieff, "Man–Made Fibres", 6th Edition, 6: pp. 900–925 (1975) (Month Unknown).

"Textile Resins", in Encyclopedia of Polymer Science and Technology, 16:682–699 (1989) (Month Unknown).

"Dyeing" in Encyclopedia of Polymer Science and Engineering, 5:226–245 (1986) (Month Unknown).

S. Kulkami et al, "Textile Dyeing Operations", pp. 2–3, 84–105 (1986) (Month Unknown).

"Dyes, Reactive" in Kirk–Othmer, Encyclopedia of Chemical Technology, 3rd edition, 8:374–385 (1979) (Month Unknown).

R. Rosenthal, "Genesis" Fiber Developed by Courtaulds, Nonwovens Ind., 17 (8):33, Paperchem No. 57–06976 (Abstract) (August, 1986).

"New Generation of Cellulose Fibers", Melliand Textilberichte/International Textile Reports, 72(2):94, Textile Technol. Dig. No. 03135/91 (Abstract) (Feb., 1991).

"Lenzing Opens Solvent–Spinning Line for Cellulose Fibres", Nonwovens Rep. Int., 237:6–7, Pira Abstract No. 07–91–00562 (Abstract) (Dec., 1990).

J. Marsh, "An Introduction to Textile Finishing", 2d ed., Chapman and Hall Ltd. (London, 1966), p. 1. (Month Unknown).

Ullmann's Encyclopedia of Industrial Chemistry, Fifth, Completely Revised Edition, vol. A10: "Ethanolamines to Fibers, 4. Synthetic Organic", Section 4.2.2. Washing and Finishing, VCH (Weinheim, 1987) (Month Unknown).

R. Moncrieff, "Man–Made Fibres", 5th ed., p. 211 (1970) (Month Unknown).

"Man–Made Fibers Science and Technology", vol. 2, p. 33, Interscience Publishers (1968) (Month Unknown).

E. Flick, "Textile Finishing Chemicals, An Industrial Guide", p. 372 (Mar., 1990).

S. Anand et al, "The Dimensional Properties of Single–Jersey Loop–Pile Fabrics, Part II: Studies of Fabrics with Textured Continuous–filament Yarns in the Ground Structure", J. Text. Inst., 5:349 (1987) (Month Unknown).

H. Nasr et al, "Wood Blends with Improved Dyeability and Stain–release Properties Through Gamma Ray Induced Grafting" Kolor. Ert., 23 (2–3):55–64 (1981) (Abstract only) (Month Unknow).

A. Hebeish et al, "Chemical Modification of Cotton Through Reaction with Alkoxy Adducts of Acrylamide and Hexahydro–1,3,5,–triacryloyl–s–triazine in Nonaqueous Medium", Angew. Makromol. Chem., 91:77–97 (1980) (Abstract only) (Month Unknown).

M. El–Kashouti et al, "Utilization of Hexahydro–1,3,5–triacryloyl–s–triazine in Cotton Printing", Cellul. Chem. Technol., 12(2):223–229 (1978) (Abstract only) (Month Unknown).

S. Rowland et al, "Polymerization–crosslinking of N–methylolacrylamide in Cotton Fabric", Text. Res. J., 48(2):73–80 (1978) (Abstract only) (Month Unknown).

M. Solarz et al, "Wrinkle–resistant Finishing of Cellulose Fabrics in an Alkaline Medium with Simultaneous Dyeing with Acid Dyes", Przegl. Wlok., 31(1):28–31 (1977) (Abstract only) (Month Unknown).

(List continued on next page.)

*Primary Examiner*—Prince Willis, Jr.
*Assistant Examiner*—Alan Diamond
*Attorney, Agent, or Firm*—Howson and Howson

[57] ABSTRACT

The fibrillation tendency of lyocell fibre can be reduced by application to the fibre of a solution of a chemical reagent which contains at least two aliphatic aldehyde groups capable of reacting with each other in aqueous solution to form a cyclic hydrate containing a —CHOH—O—CHOH— linkage, followed by reaction between the fibre and the reagent. The protection afforded by the invention is retained upon repeated laundering.

9 Claims, No Drawings

U.S. PATENT DOCUMENTS

| | | | |
|---|---|---|---|
| 3,574,522 | 4/1971 | Rowland et al. . | |
| 3,606,990 | 9/1971 | Gobert et al. | 8/111 |
| 3,663,159 | 5/1972 | Gordon . | |
| 3,839,207 | 10/1974 | Weil . | |
| 3,849,169 | 11/1974 | Cicione et al. . | |
| 3,849,409 | 11/1974 | Weil . | |
| 3,883,523 | 5/1975 | Parton . | |
| 4,090,844 | 5/1978 | Rowland . | |
| 4,125,652 | 11/1978 | Komminoth et al. . | |
| 4,185,961 | 1/1980 | Danzik . | |
| 4,246,221 | 1/1981 | McCorsley . | |
| 4,268,266 | 5/1981 | Hendricks . | |
| 4,277,243 | 7/1981 | Roland . | |
| 4,283,196 | 8/1981 | Wenghoefer . | |
| 4,336,023 | 6/1982 | Warburton . | |
| 4,371,517 | 2/1983 | Vanlerberghe . | |
| 4,416,698 | 11/1983 | McCorsley . | |
| 4,443,355 | 4/1984 | Murata et al. . | |
| 4,472,167 | 9/1984 | Welch | 8/116.4 |
| 4,483,689 | 11/1984 | Welch . | |
| 4,502,866 | 3/1985 | Brenneisen . | |
| 4,563,189 | 1/1986 | Lewis . | |
| 4,659,595 | 4/1987 | Walker et al. . | |
| 4,743,267 | 5/1988 | Dyer . | |
| 4,780,102 | 10/1988 | Harper . | |
| 4,880,431 | 11/1989 | Yokogawa et al. . | |
| 4,908,097 | 3/1990 | Box . | |
| 4,971,708 | 11/1990 | Lee . | |
| 4,999,149 | 3/1991 | Chen . | |
| 5,085,668 | 2/1992 | Pelster et al. . | |
| 5,131,917 | 7/1992 | Miyamoto et al. . | |
| 5,310,424 | 5/1994 | Taylor . | |
| 5,311,389 | 5/1994 | Howey | 360/133 |
| 5,328,757 | 7/1994 | Kenney et al. | 428/247 |
| 5,403,530 | 4/1995 | Taylor . | |

FOREIGN PATENT DOCUMENTS

| | | |
|---|---|---|
| 1158775 | 6/1958 | France . |
| 1565248 | 4/1969 | France . |
| 1576514 | 8/1969 | France . |
| 2108069 | 5/1972 | France . |
| 2273091 | 3/1974 | France . |
| 2407280 | 5/1979 | France . |
| 2450293 | 9/1980 | France . |
| 1444127 | 9/1969 | Germany . |
| 1928814 | 12/1970 | Germany . |
| 1930768 | 1/1971 | Germany . |
| 2111038 | 9/1972 | Germany . |
| 2118224 | 11/1972 | Germany . |
| 2242939 | 3/1973 | Germany . |
| 2209255 | 9/1973 | Germany . |
| 2249321 | 5/1974 | Germany . |
| 2554790 | 7/1976 | Germany . |
| 2558163 | 7/1976 | Germany . |
| 2551410 | 5/1977 | Germany . |
| 236581 | 6/1986 | Germany . |
| 48-015234 | 5/1973 | Japan . |
| 48-092668 | 12/1973 | Japan . |
| 49-001870 | 1/1974 | Japan . |
| 49-080392 | 8/1974 | Japan . |
| 50-017593 | 6/1975 | Japan . |
| 50-112598 | 9/1975 | Japan . |
| 50-112599 | 9/1975 | Japan . |
| 51-035786 | 3/1976 | Japan . |
| 52-070187 | 6/1977 | Japan . |
| 52-033718 | 8/1977 | Japan . |
| 52-111922 | 9/1977 | Japan . |
| 52-039479 | 10/1977 | Japan . |
| 52-141843 | 11/1977 | Japan . |
| 53-035017 | 4/1978 | Japan . |
| 53-078377 | 7/1978 | Japan . |
| 53-122880 | 10/1978 | Japan . |
| 55-023093 | 6/1980 | Japan . |
| 62-044077 | 9/1987 | Japan . |
| 62-210054 | 9/1987 | Japan . |
| 62-057744 | 12/1987 | Japan . |
| 89000505 | 1/1989 | Japan . |
| 1239167 | 9/1989 | Japan . |
| 1271238 | 10/1989 | Japan . |
| 1297430 | 11/1989 | Japan . |
| 3197128 | 8/1991 | Japan . |
| 4241179 | 8/1992 | Japan . |
| 4218502 | 8/1992 | Japan . |
| 4298516 | 10/1992 | Japan . |
| 6146168 | 5/1994 | Japan . |
| 71100 | 9/1976 | Poland . |
| 543484 | 12/1973 | Switzerland . |
| 465384 | 10/1975 | U.S.S.R. . |
| 576270 | 3/1946 | United Kingdom . |
| 734974 | 8/1955 | United Kingdom . |
| 810352 | 3/1959 | United Kingdom . |
| 878655 | 10/1961 | United Kingdom . |
| 936399 | 9/1963 | United Kingdom . |
| 950073 | 2/1964 | United Kingdom . |
| 953171 | 3/1964 | United Kingdom . |
| 989873 | 4/1965 | United Kingdom . |
| 1142428 | 2/1969 | United Kingdom . |
| 1271518 | 4/1972 | United Kingdom . |
| 1354406 | 5/1974 | United Kingdom . |
| 2007147 | 5/1979 | United Kingdom . |
| 2043525 | 10/1980 | United Kingdom . |
| 2103639 | 11/1984 | United Kingdom . |
| WO81/03274 | 11/1981 | WIPO . |
| WO92/07124 | 4/1992 | WIPO . |
| WO92/19807 | 11/1992 | WIPO . |
| WO94/09191 | 4/1994 | WIPO . |
| WO94/20656 | 9/1994 | WIPO . |
| WO94/24343 | 10/1994 | WIPO . |
| WO95/00697 | 1/1995 | WIPO . |
| WO95/28516 | 10/1995 | WIPO . |
| WO95/30043 | 11/1995 | WIPO . |

OTHER PUBLICATIONS

M. Solarz, "Modification of Cellulose Fibers with N,N'-methylenebisacrylamide", Przegl. Wlok., 30(11–12):546–549 (1976) (Abstract only) (Month Unknown).

J. Arthur, "Photofinishing for Cotton Textiles", U.S., Agric. Res. Serv., South. Reg., ARS–S–64, 6–7 (1975 (Abstract only) (Month Unknown).

M. Kamel et al, "Creation of Reactive Centers for Cotton, VII., Mechanism of Reaction of Cotton with Hexahydro–1, 3,5–triacryloyl–s–triazine", Text. Res. J., 45(11):800–804 (1975) (Abstract only) (Month Unknown).

M. Kamel et al, "Creation of Reaction Centers on Cotton, III., Synthesis of some New Methylolacrylamide Derivatives", Kolor. Ert., 17(7–8):217–224 (1975) (Abstract only) (Month Unknown).

J. Bogdanski, "Binding of Cellulose Xanthation by–products with Hexahydro–1,3,5–tracryloyltriazine", Zesz. Nauk.—Akad. Ekon. Poznaniu, Ser. 1, 58:143–146 (1974) (Abstract only) (Month Unknown).

H. Nasr, "Radiation Modification of Cotton Fabrics, II., Catalytic Effect of Grafted Acids", Text. Res. J., 43(10):607–608 (1973) (Abstract only) (Month Unknown).

A. Wawrzynaik, "Dyeing Cellulose Fibers with azo Dyes Coupled to the Fiber Through a Reactive Intermediate", Przegl. Wlok., 26(6):337–347 (1972) (Abstract only) (Month Unknown).

H. Nasr, "Radiation Modification of Cotton Fabrics, I., Crosslinking Cotton Using Multifunctional Monomers", Text. Res. J., 42(8):497–499 (1972) (Abstract only) (Month Unknown).

A. Wawrzynaik et al, "Nature of the Chemical Reaction Between an Anionic Dye and Cellulose in the Presence of a Free Reactive System", Przegl. Wlok., 25(12):647–653 (1971) (Abstract only) (Month Unknown).

M. Kamel et al, "Dye Fixation Using Hexahydro–1,3,5–triacryloyl–s–triazine", Amer. Dyest. Rep., 60(3):33–34, 38, 40, 42 (1971) (Abstract only) (Month Unknown).

G. Valk et al, "Creation of Reactive Centers on Cellulose Using Hexahydro–1,3,5–triacryloyl–s–triazine", Text. Res. J., 41(4):364 (1971) (Abstract only) (Month Unknown).

S. Rowland et al, "Reaction of Activated Vinyl Compounds with Cotton Cellulose via Internal Catalysis", J. Appl. Polym. Sci., 14(2):441–452 (1970) (Abstract only) (Month Unknown).

F. Schlaeppi et al, "Fixation of Dyes by High Energy Irradiation", Text. Chem. Color, 2(24):414–424 (1970) (Abstract only) (Month Unknown).

G. Valk et al, "Analysis of High–Grade Finishes, 7., Chemical Detection of the Cross–linking of Cotton with N–acrylamide Derivatives", Melliand Textilber., 51(6):714–719 (1970) (Abstract only) (Month Unknown).

M. Chekalin et al, "Fixation of Dyes Containing Labile Hydrogen on Cotton Fabrics by Means of Polyfunctional Compounds", Tekst. Prom. (Moscow), 28(9):40–43 (1968) (Abstract only) (Month Unknown).

R. Harper, "Crosslinking, Grafting and Dyeing: Finishing for Added Properties", Textile Chemist and Colorist, 23(11):15–20 (Nov., 1991).

"Sulfonation and Sulfation to Thorium and Thorium Compounds" in Kirk–Othmer, Encyclopedia of Chemical Technology, 3rd edition, 22:769–790 (1983) (Month Unknown).

H. Petersen, "The Chemistry of Crease–Resist Crosslinking Agent", Rev. Prog. Coloration, 17:7–22 (1987) (Month Unknown).

P. Pavlov et al, "Properties of Viscose Fibres Modified in an As–spun State by Cross–Linking", J. Textile Institute, 78(5):357–361 (Sep.–Oct., 1987).

N. Bertoniere et al, "Pore Structure of Cotton Fabrics Crosslinked with Formaldehyde–Free Reagents", Textile Research Journal, 62(6):349–356 (Jun., 1992).

M. Hurwitz et al, "Dialdehydes as Cotton Cellulose Cross–Linkers", Textile Research Journal, 28(3):257–262 (Mar., 1958).

H. Nemec, "Fibrillation of Cellulosic Materials—Can Previous Literature Offer a Solution?", Lenzinger Berichte, 9:69–72 (Sep., 1994).

M. Dube et al, "Precipitation and Crystallization of Cellulose from Amine Oxide Solutions", in *Proceedings of the Technical Association of the Pulp and Paper Industry, 1983 International Dissolving and Speciality Pulps Conference,* TAPPI Press, pp. 111–119 (1983) (Month Unknown).

LYOCELL FIBER TREATMENT METHOD

FIELD OF THE INVENTION

This invention relates to methods of reducing the fibrillation tendency of lyocell fibres.

It is known that cellulose fibre can be made by extrusion of a solution of cellulose in a suitable solvent into a coagulating bath. This process is referred to as "solvent spinning", and the cellulose fibre produced thereby is referred to as "solvent-spun" cellulose fibre or as lyocell fibre. Lyocell fibre is to be distinguished from cellulose fibre made by other known processes, which rely on the formation of a soluble chemical derivative of cellulose and its subsequent decomposition to regenerate the cellulose, for example the viscose process. One example of a solvent spinning process is described in U.S. Pat. No. 4,246,221, the contents of which are incorporated herein by way of reference. Cellulose is dissolved in a solvent such as an aqueous tertiary amine N-oxide, for example N-methylmorpholine N-oxide. The resulting solution is then extruded through a suitable die into an aqueous bath to produce an assembly of filaments, which is washed with water to remove the solvent and is subsequently dried.

Fibres may exhibit a tendency to fibrillate, particularly when subjected to mechanical stress in the wet state. Fibrillation occurs when fibre structure breaks down in the longitudinal direction so that fine fibrils become partially detached from the fibre, giving a hairy appearance to the fibre and to fabric containing it, for example woven or knitted fabric. Dyed fabric containing fibrillated fibre tends to have a "frosted" appearance, which may be aesthetically undesirable. Such fibrillation is believed to be caused by mechanical abrasion of the fibres during treatment in a wet and swollen state. Wet treatment processes such as dyeing processes inevitably subject fibres to mechanical abrasion. Higher temperatures and longer times of treatment generally tend to produce greater degrees of fibrillation. Lyocell fibre appears to be particularly sensitive to such abrasion and is consequently often found to be more susceptible to fibrillation than other types of cellulose fibre. The present invention is concerned with methods of treatment of lyocell fibre so as to reduce or inhibit its tendency to fibrillate. It has however been found that some such methods of treatment may have detrimental effects on the mechanical properties of the fibre such as its tenacity and extensibility, for example by embrittling the fibre, or on the processability of the fibre and fabric, in particular its dyeability. It can be difficult to identify a method of treatment which provides a satisfactory reduction in fibrillation tendency whilst avoiding such detrimental effects.

DESCRIPTION OF RELATED ART

EP-A-538,977 discloses that the fibrillation tendency of lyocell fibre can be reduced by treating the fibre with a chemical reagent having two to six functional groups reactive with cellulose. The chemical reagent is preferably colourless. Examples of suitable functional groups include reactive halogen atoms attached to a polyazine ring as well as vinyl sulphones and precursors thereof. Such chemical reagents are in general relatively expensive materials.

SUMMARY OF THE INVENTION

A method according to the invention for providing lyocell fibre with a reduced fibrillation tendency, including the steps of applying to the fibre a chemical reagent having at least two functional groups reactive with cellulose and producing reaction between the fibre and the chemical reagent, is characterised in that at least two of said functional groups are aliphatic aldehyde groups susceptible of reaction with each other in aqueous solution to form a cyclic hydrate containing a —CHOH—O—CHOH— linkage. The chemical reagent preferably contains two aliphatic aldehyde groups of this type. The chemical reagent preferably contains a total of two to six functional groups reactive with cellulose.

DETAILED DISCLOSURE

Examples of suitable chemical reagents include succinaldehyde, oxybisacetaldehyde and particularly glutaraldehyde. These compounds have the chemical formula OCH—X—CHO, wherein X is $(CH_2)_2$, $CH_2OCH_2$ and $(CH_2)_3$ respectively. In aqueous solution, they are in equilibrium with the corresponding cyclic hydrates:

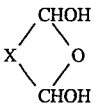

which contain the specified —CHOH—O—CHOH— linkage.

The chemical reagent may be applied to the lyocell in never-dried or previously-dried form. Never-dried fibre is fibre which has been made by a wet-spinning process such as a solvent spinning process and which has been washed in preparation for drying but has not yet been dried. Previously-dried lyocell fibre is preferably treated in fabric form, for example in the form of woven or knitted fabric, although the invention also contemplates the treatment of fibre in other physical forms such as tow, staple fibre and spun yarn.

The chemical reagent is preferably applied to the lyocell fibre by contacting the fibre with an aqueous solution of the reagent. For example, the solution may be padded onto the fibre or the fibre may be passed through a bath of the solution. Chemical reagents which are soluble in water are preferred. The concentration of the chemical reagent may be in the range 0.1 to 5 percent, preferably about 1 to about 2 percent, by weight.

The chemical reagent is preferably used in conjunction with an acid catalyst to accelerate reaction between the chemical reagent and the cellulose. The acid catalyst is preferably involatile under the conditions at which the reaction takes place. For example, it may be a mineral acid such as phosphoric acid, an involatile organic acid such as citric acid, oxalic acid or pyruvic acid, or a metal salt acid catalyst such as magnesium chloride or zinc nitrate. The acid catalyst is preferably applied to the fibre from an aqueous solution which also contains the chemical reagent. The amount of acid catalyst employed depends in general on the chemical nature of the acid catalyst, and it may for example be about one quarter to about three quarters by weight of the amount of the chemical reagent.

A flexible linear polymer having terminal functional groups reactive with the functional groups in the chemical reagent may additionally be applied to the lyocell fibre. The flexible linear polymer is preferably soluble in water, and it is preferably applied to the fibre from an aqueous solution which contains both the chemical reagent and the flexible linear polymer. The concentration of the flexible linear polymer in the solution may be in the range 0.1 to 5 percent, preferably 0.25 to 2.5 percent, by weight. The flexible linear polymer is preferably a wholly aliphatic polymer. The backbone of the flexible linear polymer is preferably unbranched. The flexible linear polymer preferably contains no functional groups reactive with cellulose or with the crosslinking agent other than the terminal functional groups. The terminal functional groups are preferably hydroxyl groups, although other types of groups such as amino groups may also be suitable in some cases. Preferred types of flexible linear polymer include polymerised glycols such as polypropylene glycol (PPG) and in particular polyethylene glycol (PEG). Amine-tipped derivatives of such polymerised glycols may be used.

It will be understood that such flexible linear polymers are generally mixtures of molecules having a range of chain lengths and are characterised in terms of their average molecular weight and chain length. The flexible linear polymer is capable of reacting through its functional groups to provide a linear chain corresponding to the polymer backbone, preferably containing on average about 5 to 150 atoms, more preferably about 10 to 100 atoms, further preferably about 20 to 40 atoms, in the chain. A preferred example of a flexible linear polymer is PEG having an average molecular weight in the range 100 to 2000, more preferably 200 to 1500 or 300 to 600.

To the lyocell fibre may additionally be applied an amino compound to provide basic dye sites in the treated fibre, for example a primary or secondary monoamine, diamine, triamine or tetraamine of low molecular weight (up to about 250). The amino compound is preferably soluble in water, and it is preferably applied to the fibre from an aqueous solution which contains both the chemical reagent and the amino compound. Examples of suitable amines include 1-aminoethyl-piperazine and 1,6-hexanediamine. The concentration of amino compound is generally appreciably less than that of the chemical reagent, for example about 0.5 percent by weight in the solution. The most suitable amines can be chosen by trial.

The reaction between the functional groups in the chemical reagent on the one hand and the hydroxyl groups in cellulose and the reactive groups in the optional flexible linear polymer and optional amino compound on the other hand may generally be referred to as curing. The curing reaction may occur at ambient temperature or preferably it may be carried out at elevated temperature by heating the fibre. After application of the chemical reagent, it is generally desirable to dry the fibre before curing, and this drying step may be performed in conventional manner. The heating step during which curing occurs is generally subsequent to, but may be part of, the drying step. The temperature of the curing step may generally be in the range 105° to 170° C., often about 140° C.

After curing, the fibre is generally washed and dried. Washing removes catalyst and unreacted reagent and permits the pH of the dried fibre to be controlled at a desired value, for example around neutral pH. These washing and drying steps may not always be required if an organic acid such as oxalic acid or pyruvic acid is used as acid catalyst, particularly if the lyocell fibre is treated with an amino compound as described hereinabove.

The washing step may include a wash with a dilute aqueous solution of hydroxylamine, containing for example 0.1 to 1.0 percent hydroxylamine by weight. It has been found that lyocell fibre treated according to the general method of the invention and washed in this manner exhibits good resistance to yellowing when subsequently dried.

It has surprisingly been found that the chemical reagents used in the method of the invention react advantageously more rapidly with cellulose than do aldehydes which do not form cyclic hydrates. It has also been found that these chemical reagents are substantially involatile under the conditions of a heated curing reaction, so that they react efficiently with the cellulose.

The benefit of known treatments which reduce the fibrillation tendency of lyocell fibre may be lost on repeated laundering, which is generally carried out under mildly alkaline conditions. The method of the present invention has the advantage that it provides protection against fibrillation which survives laundering for longer than such known treatments. It has surprisingly been found that the protection against fibrillation afforded by the method of the invention may be enhanced by alkaline scouring or laundering.

Lyocell fibre was assessed for degree of fibrillation using the method described below as Test Method 1 and assessed for fibrillation tendency using the techniques described below as Test Methods 2(i) and 2(ii).

TEST METHOD 1

Assessment of Fibrillation

There is no universally accepted standard for assessment of fibrillation, and the following method was used to assess Fibrillation Index (F.I.). Samples of fibre were arranged into a series showing increasing degrees of fibrillation. A standard length of fibre from each sample was then measured and the number of fibrils (fine hairy spurs extending from the main body of the fibre) along the standard length was counted. The length of each fibril was measured, and an arbitrary number, being the number of fibrils multiplied by the average length of each fibril, was determined for each fibre. The fibre exhibiting the highest value of this arbitrary number was identified as being the most fibrillated fibre and was assigned an arbitrary Fibrillation Index of 10. A wholly unfibrillated fibre was assigned a Fibrillation Index of zero, and the remaining fibres were graded from 0 to 10 based on the microscopically measured arbitrary numbers.

The measured fibres were then used to form a standard graded scale. To determine the Fibrillation Index for any other sample of fibre, five or ten fibres were visually compared under the microscope with the standard graded fibres. The visually determined arbitrary numbers for each fibre were then averaged to give a Fibrillation Index for the sample under test. It will be appreciated that visual determination and averaging is many times quicker than measurement, and it has been found that skilled fibre technologists are consistent in their rating of fibres.

Fibrillation Index of fabrics can be assessed on fibres drawn from the surface of the fabric. Woven and knitted fabrics having an F.I. of more than about 2.0 to 2.5 exhibit an unsightly appearance.

TEST METHOD 2

Inducement of Fibrillation (i) Scour 1 g fibre was placed in a stainless steel cylinder approximately 25 cm long by 4 cm diameter and having a capacity of approximately 250 ml. 50 ml conventional scouring solution containing 2 g/l Detergyl FS955 (an anionic detergent available from ICI plc) (Detergyl is a Trade Mark) and 2 g/l sodium carbonate was added, a screw cap was fitted and the capped cylinder was tumbled end-over-end at 60 tumbles per minute for 60 minutes at 95° C. The scoured fibre was then rinsed with hot and cold water.

(ii) Blender 0.5 g scoured fibre cut into 5–6 mm lengths and dispersed in 500 ml water at ambient temperature was placed in a household blender (liquidiser) and the blender was run for 2 minutes at about 12000 rpm. The fibre was then collected and dried.

The invention is illustrated by the following Examples, in which parts and proportions are by weight unless otherwise specified. In each case, lyocell fibre was prepared by extrusion of a solution of cellulose in a mixture of N-methylmorpholine N-oxide (NMMO) and water into dilute aqueous NMMO to coagulate it, followed by washing with water to remove NMMO. Fibrillation was induced by Test Method 2 and assessed by Test Method 1.

EXAMPLE 1

Never-dried lyocell fibre was treated with an aqueous solution containing 3.0–3.5% of a 50% aqueous solution of glutaraldehyde and 1% of an 85% aqueous solution of phosphoric acid. The fibre was dried at 120° C. It was then washed with highly dilute aqueous ammonia, squeezed to express water and dried. The F.I. of the fibre was 0.0 and 0.2 (duplicate experiments).

An untreated control sample of lyocell fibre exhibited F.I. 3.9.

EXAMPLE 2

Never-dried lyocell fibre was treated with an aqueous solution containing 4% of a 50% aqueous solution of glutaraldehyde and 1% of an 85% aqueous solution of phosphoric acid. It was then mangled to express water and air-dried overnight. The dried fibre was heated at 115° C. for 15 min. It was then washed with a 1% aqueous solution of hydroxylamine hydrochloride containing sufficient sodium carbonate to adjust the pH to 9–10. The fibre was finally dried. It exhibited F.I. 0.3.

EXAMPLE 3

Never-dried lyocell fibre was treated with an aqueous solution containing 3.3% of a 50% aqueous solution of glutaraldehyde, 1.5% of an 85% aqueous solution of phosphoric acid and 0.2% aminoethylpiperazine. It was then mangled to express water and dried at 125° C. for 25 min. The dried fibre was washed with an aqueous solution containing 0.5% hydroxylamine hydrochloride, 2.0% conc. ammonia and 0.5% NaOH and finally dried. It exhibited F.I. 0.0.

EXAMPLE 4

Dry lyocell fibre (1.1 g) was dipped in an aqueous solution containing glutaraldehyde (1.25% as the pure compound) and oxalic acid dihydrate (1.5%), mangled to express excess solution (wet fibre weight 1.8 g) and dried at 120° C. for 20 min. The treated fibre initally exhibited excellent resistance to fibrillation, although this resistance lessened on storage.

The treated fibre was given an alkaline wash after the heating step and dried, as in Example 1. This washed fibre exhibited excellent resistance to fibrillation.

EXAMPLE 5

Example 4 was repeated, except that the solution contained 0.9% and 0.3% glutaraldehyde and oxalic acid dihydrate respectively. The treated fibre initially exhibited good resistance to fibrillation, although this resistance lessened on storage.

The treated fibre was given an alkaline wash after the heating step and dried, as in Example 1. This washed fibre exhibited excellent resistance to fibrillation.

EXAMPLE 6

Samples of lyocell fibre were dipped into aqueous solutions containing glutaraldehyde (approx. 1.5%) and phosphoric acid (approx. 1%) and squeezed to express excess solution. The sample was then dried and heated in an oven at 120°–125° C. for approx. 25 mins (except where otherwise specified below). The fibre was then washed to remove residual catalyst and dried. The details of the various treatments were as follows:

A. Small sample, previously dried fibre.

B. Large sample, never-dried fibre. The sample was air-dried and heated at approx 110°–115° C. for 10–15 min. The fibre was subsequently scoured and bleached twice.

C. Large sample, never-dried fibre.

D. Large sample, never-dried fibre. The solution additionally contained 1-(2-aminoethyl)-piperazine (0.2 %).

E. Small sample, previously dried fibre. The solution additionally contained 1,6-hexanediamine (0.2%).

F. Sample E, subsequently scoured by boiling in aqueous $Na_2CO_3$ (5% as the decahydrate) for 30 min.

G. Small sample, previously dried fibre. The solution additionally contained methyl cystinate hydrochloride (0.2%).

H. Small sample, previously dried fibre. The solution additionally contained 1-(2-aminoethyl)-piperazine (0.5%).

I. Sample H, subsequently scoured.

J. Small sample, previously dried fibre. The solution additionally contained cystamine hydrochloride (0.2%).

The small samples weighed 1–2 g, the large samples 20–30 g.

The tensile properties of the fibres were measured, and the results are shown in Table 1:

TABLE 1

| Ref. | dtex | Tenacity cN/tex | Elongation % | Initial Dry Modulus cN/tex |
|---|---|---|---|---|
| Control | 1.7 | ca. 40 | ca. 14 | — |
| A | 1.8 | 39.2 | 9.2 | 1140 |
| B | 1.9 | 39.2 | 8.6 | 1120 |
| C | 1.8 | 39.7 | 8.9 | 1180 |
| D | 2.0 | 38.9 | 10.8 | 1150 |
| E | 1.8 | 38.0 | 10.0 | 1230 |
| F | 1.7 | 32.5 | 8.3 | 953 |
| G | 1.8 | 30.4 | 6.3 | 1250 |
| H | 1.8 | 39.5 | 11.6 | 1130 |
| I | 1.7 | 38.9 | 12.2 | 1110 |
| J | 1.8 | 27.3 | 6.4 | 1120 |

Initial Dry Modulus was measured at a loading of 0.5–1.0 cN/tex.

It should be noted that the sulphur-containing amines used in G and J induced an undesirable reduction in tensile properties.

EXAMPLE 7

Samples of never-dried lyocell fibre were dipped into aqueous solutions containing glutaraldehyde (approx. 1.5%) and phosphoric acid (approx. 1%), squeezed to express excess solution, dried and heated in an oven at 120° C. The fibre was then washed to remove residual catalyst and dried. The washing liquor optionally contained alkaline hydroxylamine (0.5%). The fibre was assessed for fibrillation tendency using Test Methods 1 and 2 and for dyeability. The results are shown in Table 2; reference letters B, C and D refer to the treatment conditions described in Example 6:

TABLE 2

| | F.I. | Dyeability |
|---|---|---|
| Control | 3.0 | Standard |
| B (but omitting the twofold bleach/scour) | 0.0, 0.2 | Paler |
| C (hydroxylamine wash) | 0.3 | Paler |
| D (hydroxylamine wash) | 0.0 | Paler |

I claim:

1. A method of providing lyocell fibre with a reduced fibrillation tendency comprising the steps of applying to the lyocell fibre a chemical reagent having at least two functional groups reactive with cellulose, wherein at least two of said functional groups are aliphatic aldehyde groups susceptible of reaction with each other in aqueous solution to form a cyclic hydrate containing a —CHOH—O—CHOH— linkage; and producing reaction between the fibre and the chemical reagent, whereby fibrillation tendency of said lyocell fibre is reduced.

2. The method according to claim 1, in which the chemical reagent is selected from the group consisting of succinaldehyde, oxybisacetaldehyde and glutaraldehyde.

3. The method according to claim 1, wherein said applying step comprises applying the chemical reagent to never-dried lyocell fibre.

4. The method according to claim 1, wherein said applying step comprises applying the chemical reagent to previously-dried lyocell fibre.

5. The method according to claim 1, wherein said applying step comprises applying the chemical reagent to the fibre from an aqueous solution comprising 0.1 to 5 percent by weight of said chemical reagent.

6. The method according to claim 1, further comprising applying an acid catalyst which accelerates the reaction between the lyocell fibre and the chemical reagent to the lyocell fibre prior to the step of producing reaction between the fibre and the chemical reagent.

7. The method according to claim 1, further comprising applying a flexible linear polymer having terminal functional groups reactive with the functional groups in the chemical reagent to the lyocell fibre prior to the step of producing reaction between the fibre and the chemical reagent.

8. The method according to claim 1, further comprising applying an amino compound to the lyocell fibre prior to the step of producing reaction between the fibre and the chemical reagent, the amino compound being selected from the group consisting of primary and secondary monoamines, diamines, triamines and tetraamines of molecular weight 250 or less.

9. The method according to claim 1, further comprising washing the lyocell fibre with an aqueous solution of hydroxylamine subsequent to the step of producing reaction between the fibre and the chemical reagent.

* * * * *